US006123564A

United States Patent [19]

Belmore, III

[11] Patent Number: 6,123,564

[45] Date of Patent: Sep. 26, 2000

[54] APPARATUS AND METHODS FOR TESTING ELECTRONIC CIRCUITRY WITH MULTIPLE CONNECTOR SOCKET ARRAYS

[75] Inventor: Walter J. Belmore, III, Spring, Tex.

[73] Assignee: Compaq Computer Corporation, Houston, Tex.

[21] Appl. No.: 09/009,667

[22] Filed: Jan. 20, 1998

[51] Int. Cl.[7] ..... H01R 13/625

[52] U.S. Cl. ..... 439/344; 439/352; 439/310; 324/538

[58] Field of Search ..... 439/344, 540.1, 439/701, 715, 660, 310, 352, 354, 345; 340/538

[56] References Cited

U.S. PATENT DOCUMENTS

| | | | |
|---|---|---|---|
| 5,191,282 | 3/1993 | Liken et al. | 439/310 |
| 5,411,416 | 5/1995 | Balon et al. | 439/540.1 |
| 5,415,570 | 5/1995 | Sarkissian | 439/660 |
| 5,689,191 | 11/1997 | Kahiyama | 439/489 |
| 5,743,755 | 4/1998 | Aoki | 439/354 |
| 5,795,174 | 8/1998 | Saito et al. | 439/310 |

*Primary Examiner*—Renee S. Luebke
*Assistant Examiner*—T. C. Patel
*Attorney, Agent, or Firm*—Konneker & Smith, P.C.

[57] ABSTRACT

A series of modular plugs insertable into a row of connector sockets mounted on a circuit board to be tested are secured to a specially designed support structure which enables the plugs to be simultaneously mated with the sockets to thereby substantially reduce the required test connection time and to enable the plugs to be coupled with and uncoupled from the sockets without subjecting the plug cables to appreciable handling stress. In one embodiment thereof the support structure may be manually moved toward the sockets to effect the coupling of the plugs with their sockets, and a movable latch plate member is carried by the support structure for use in simultaneously unlatching the inserted plugs from their sockets. In another embodiment thereof the support structure is stationarily secured to a specially designed test stand assembly which is operable to move the circuit board toward the stationary plugs to effect the desired plug/socket test interconnection.

20 Claims, 4 Drawing Sheets

APPARATUS AND METHODS FOR TESTING ELECTRONIC CIRCUITRY WITH MULTIPLE CONNECTOR SOCKET ARRAYS

BACKGROUND OF THE INVENTION

1. Field of the Invention

The present invention generally relates to apparatus and methods for testing electronic circuitry and, in a preferred embodiment thereof, more particularly provides apparatus for testing electronic devices, such as printed circuit boards, having multiple connector socket arrays thereon.

2. Description of Related Art

Electronic circuitry, such as that built into printed circuit boards, is typically tested for proper construction and functioning before being incorporated into the associated end product such as a computer. Because of the complex circuitry and small component sizes involved, this type of testing can be quite tedious and time consuming. It can also require a great deal of manual dexterity and patience to make the required connections to the electronic UUT (unit under test) to enable its circuitry to be properly tested.

For example, in computer network system circuit boards a series of electrical connector sockets are typically mounted in a row arrangement on a side edge portion of the circuit board body to receive corresponding modular telecommunication plugs (such as RJ45 plugs) in the finished electronic product. Using current test techniques it is necessary for a technician to manually insert modular test plugs one by one into the series of connector sockets, test the circuit board, and then manually uncouple the test plugs one by one from the sockets.

It has proven to be ergonomically impractical for a technician to manually insert and subsequently remove each plug one by one in a high volume manufacturing environment such as the computer industry. Simply stated, it is physically very difficult for a person to individually plug a high number of connectors into, and then remove them from, the mating hardware over long periods of time. Additionally, the plugs, the mating hardware or the circuit board itself can be damaged by manually inserting and disconnecting the test plugs individually. In the case of RJ45 modular plugs the probability of their associated cable being damaged increases because the technician does not have anything to push or pull on other than the cable itself. The resulting damage to the test plug cables can lead to increased testing downtime, thus creating increased manufacturing costs. It is to these problems which the present invention is directed.

SUMMARY OF THE INVENTION

In carrying out principles of the present invention, in accordance with a preferred embodiment thereof, specially designed apparatus is provided for testing an electronic device, representatively a circuit board, having a series of first electrical connectors thereon.

From a broad perspective, the apparatus comprises a series of second electrical connectors releasably mateable with the series of first electrical connectors, and a support structure operable to support the series of second electrical connectors in an arrangement permitting them to be simultaneously mated with the first electrical connectors in response to a predetermined relative movement between the electronic device and the support structure.

The support of the second electrical connectors, in a manner permitting them to simultaneously mated with the first electrical connectors on the electronic device to be tested, advantageously avoids the previous necessity of laboriously mating the connector pairs one by one, makes the overall test process considerably less time-consuming and expensive, and avoids the problem of exerting insertion and withdrawal forces on the cables connected to the second electrical connectors.

In one representative embodiment of the apparatus, using modular test plugs to test a circuit board having a row of electrical sockets thereon, the support structure includes a first plate member having a side from which a spaced series of retaining pins transversely project, and a retainer member having a base defined by a second plate member having a series of transverse rib structures projecting from a first side thereof and having first lateral portions spaced to complementarily receive between adjacent pairs thereof end portions of the plugs having exterior surface recesses therein.

Means are provided for removably securing the first plate member to the retainer member in a manner such that the rib structures extend between the first plate member and the second plate member, and the retaining pins extend into the spaces between the first lateral rib portions for receipt in the exterior surface depressions of the end portions of the plugs. In this manner, the first lateral rib portions preclude appreciable movement of the plugs transverse to the rib structures, and the retaining pins preclude appreciable movement of the plugs parallel to the rib structures.

The modular plugs have deflectable latch portions, and the support structure, which is movable toward the circuit board sockets, preferably also includes a release structure which is operable to simultaneously deflect the latch portions to facilitate simultaneous withdrawal of the plugs from their associated circuit board sockets. The release structure illustratively includes a release member carried by the second plate member for movement toward and away therefrom into and out of deflecting engagement with the latch portions of the modular plugs carries between the first lateral rib portions.

According to other features of this embodiment of the test apparatus, which may be manually utilized by a technician to simultaneously mate the test plugs with the circuit board sockets, the second plate member has cutout areas disposed therein, such cutout areas being positioned and configured to receive parts of the deflected latch portions.

In another illustrative embodiment of the test apparatus of the present invention the support structure is stationarily secured to a base portion of a specially designed test stand assembly having a movable portion to which the circuit board may be secured and forcibly moved toward the plugs retained by the support structure to simultaneously mate the circuit board sockets with the stationary modular test plugs. As in the case of the first representative embodiment of the invention, the test plugs are illustratively conventional RJ45 modular electrical plugs.

In this invention embodiment the circuit board has a power receiving connector thereon for receiving electrical power from a source thereof, and the test stand assembly preferably further includes an electrical power supply structure having a power supply connector disposed thereon and releasably mateable with the power receiving connector, and holding apparatus for supporting the electrical power supply structure for movement toward and away from the supported circuit board to permit the power supply connector to be selectively mated with and uncoupled from the power receiving connector when the circuit board is operatively supported on the test stand assembly.

According to other features of the test stand assembly, the electrical power supply structure is an electrical power supply box, and the holding apparatus is a housing slidably receiving the electrical power supply box. The test stand assembly further includes a bracing structure operative to brace the series of circuit board electrical connector sockets against connection forces imposed thereon by the stationarily supported plugs. The bracing structure illustratively includes a bracing member carried by the portion of the test stand assembly which movably supports the circuit board to be tested, and is movable relative thereto into and out of a bracing relationship with the sockets on the circuit board when the circuit board is operatively supported on the test stand assembly.

DETAILED DESCRIPTION

Figure 1:
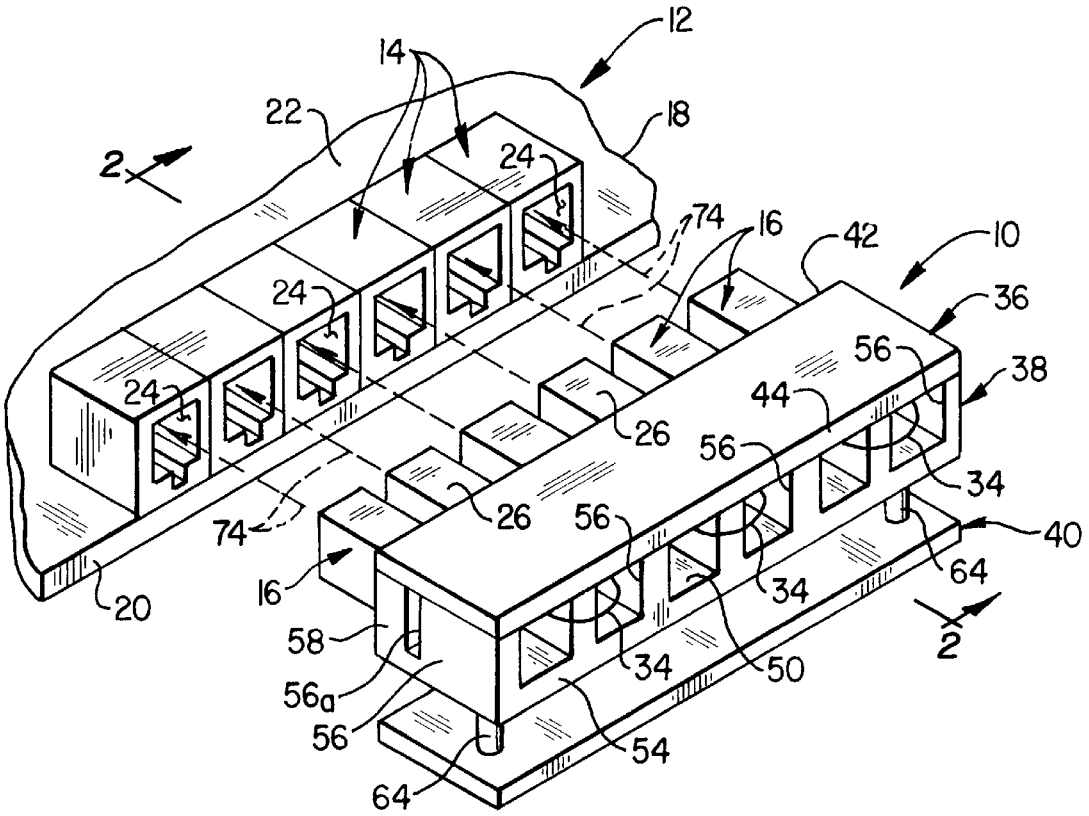
FIG. 1 is a simplified, somewhat schematic perspective view of a multi-plug support structure embodying principles of the present invention being representatively utilized to support a series of modular plugs insertable into a corresponding series of socket connectors mounted on a circuit board to be tested.
Figure 2:
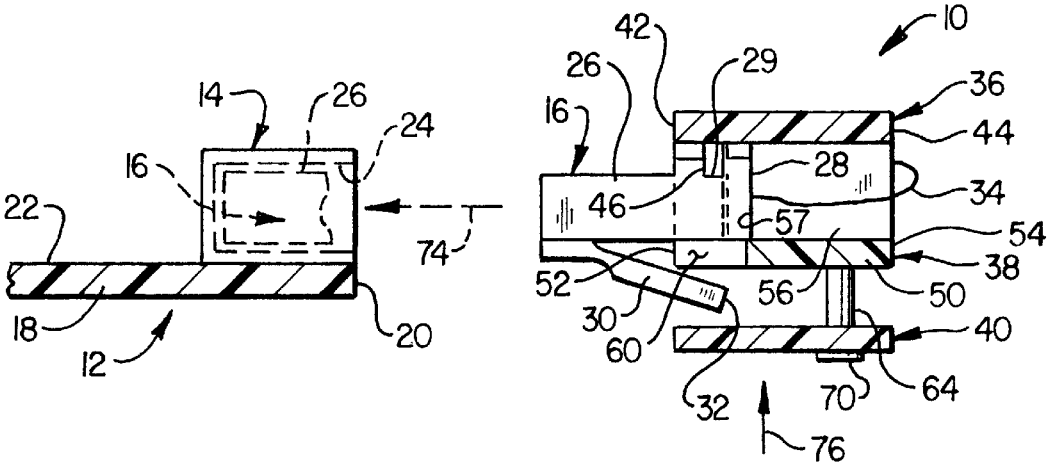
FIG. 2 is a simplified cross-sectional view through the support structure and the socket connectors taken generally along line 2—2 of FIG. 1.
Figure 3:
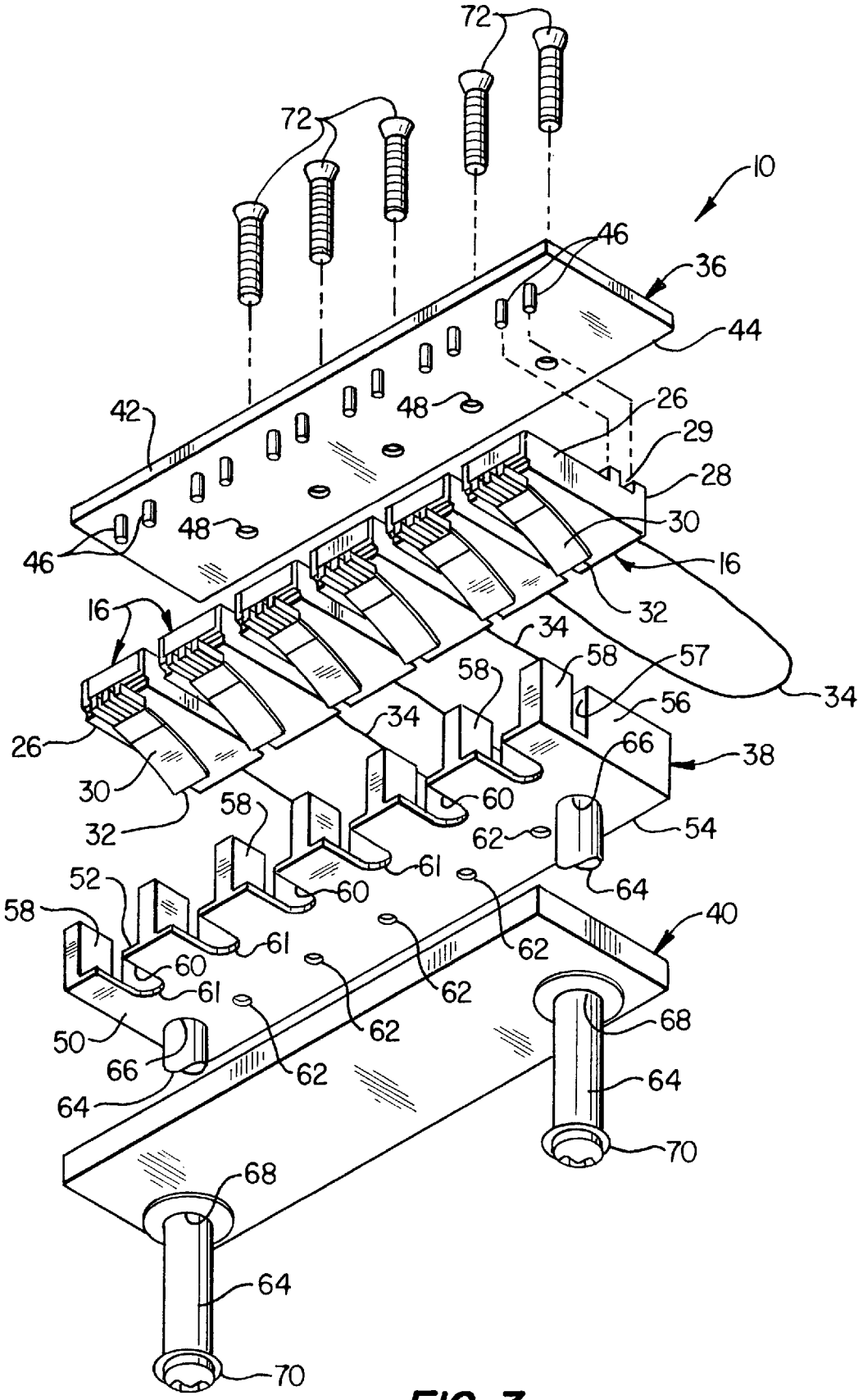
FIG. 3 is an enlarged scale exploded perspective view of a portion of the multi-plug support structure.

Referring initially to FIGS. 1–3, the present invention provides specially designed apparatus 10 for use in testing an electronic device, representatively a circuit board 12, having a series of electrical connector sockets 14 disposed thereon and adapted to releasably receive a corresponding series of electrical connector plugs 16. The circuit board 12 has the usual planar body or substrate member 18 with an edge 20 and a top side 22. Sockets 14 are disposed in the indicated row on the top side 22 of the circuit board body 18, adjacent the edge 20, with the socket row being parallel to the edge 20 and the socket openings 24 facing horizontally outwardly relative to the edge 20.

Representatively, the circuit board 12 is a network server board for a computer, and the plugs 16 are modular telecommunication plugs, for example RJ45 plugs, of conventional construction. In the finished computer product in which the circuit board 12 will ultimately be incorporated, modular plugs similar to the test plugs 16 will be releasably insertable into the sockets 14 which are electrically coupled to the circuitry (not shown) of the board 12.

Each modular plug 16 is of a conventional configuration and has an elongated, generally rectangularly cross-sectioned body 26 with an upturned rear end 28 having formed therein a top side recess 29 with a horizontal length extending generally transversely to the length of the body 26. An elongated latching tab member 30 has a front end anchored to a front underside portion of the plug body 26, and a free rear or outer end 32. As best illustrated in FIGS. 2 and 3, from its front end, each tab 30 slopes downwardly and rearwardly relative to the underside of its associated plug body 26. In a conventional manner, when a plug 16 is inserted into one of the sockets 14, its latching tab member 30 is upwardly bent and functions to releasably latch the plug within the socket. By pushing the rear end 32 of the tab 30 upwardly the inserted plug 16 is unlatched and may be pulled rearwardly out of its associated socket 14. As illustrated in FIGS. 1 and 2, adjacent pairs of the test plugs 16 are electrically interconnected by looped sections of electrical cable 34.

The conventional method of utilizing the plugs 16 to test the circuit board 12 is for a technician to manually insert the plugs 16 one by one into the sockets 14, run the circuit board test, and then manually remove the plugs 16 one by one from the sockets 14. This traditional test method carries with it a variety of well known problems, limitations and disadvantages.

For example, it has proven to be ergonomically impractical for a technician to manually insert and subsequently remove each plug individually in a high volume manufacturing environment such as the computer industry. Simply stated, it is physically very difficult for a person to move a high number of connectors one by one into and out of the mating hardware over long periods of time. Additionally, the test plugs 16, the mating sockets 14 and/or the circuit board 12 itself can be damaged by manually inserting and disconnecting the test plugs 16 individually. In the case of the representatively illustrated RJ45 modular plugs the probability of their associated cables 34 being damaged increases because the technician does not have anything to push or pull on other than the cable itself when inserting and later removing the plugs. The resulting damage to the test plug cables can lead to increased testing downtime, thus creating increased manufacturing costs.

These problems, limitations and disadvantages are uniquely eliminated in the present invention using the specially designed testing apparatus 10 which serves to hold all of the test plugs 16 in an array which permits the apparatus 10 to be used to simultaneously insert all of the plugs 16 into their associated sockets 14 without placing any stress on the plug cables 34.

Still referring to FIGS. 1–3, the testing apparatus 10 includes an elongated rectangular top plate member 36, an elongated retainer bracket member 38, and an elongated rectangular bottom release plate member 40. The top plate member 36 has front and rear side edges 42 and 44, a spaced series of retaining pin members 46 depending from the bottom side of the top plate member and arranged in a row parallel to and inwardly adjacent its front side edge 42, and a spaced series of five circular mounting holes 48 arranged in a row parallel to and inwardly adjacent its rear side edge 44.

The retainer bracket member 38 has an elongated rectangular base plate member 50 with front and rear side edges 52 and 54. Projecting upwardly from the top side of the base plate member 50 are a longitudinally spaced series of rear ribs 56 positioned adjacent the rear side edge 54 and having front side edges 57, and a longitudinally spaced series of front ribs 58 which are positioned adjacent the front side edge 52, aligned with and spaced forwardly apart from the rear ribs 56, and somewhat thinner than the rear ribs 56. Each adjacent pair of the front ribs 58 are spaced apart a distance permitting the upturned rear end portion 28 of one of the plugs 16 to be complementarily inserted therebetween, as later described herein, so that the rear end face of the plug abuts front side edges 57 of a corresponding pair of the rear ribs 56.

Between each adjacent pair of the front ribs 58 a tab recess 60 extends rearwardly through the base plate member 50 from its front side edge 52, each recess 60 having a curved rear end 61 positioned just forwardly of the aligned front end surfaces of the rear ribs 56. Also formed in the base plate member 50, near its rear side edge 54, are a spaced series of five circular mounting openings 62.

The upper ends of a pair of elongated cylindrical support rods 64 project downwardly from opposite ends of the base plate member 50 and are suitably anchored within corresponding circular openings 66 in the base plate member 50. Support rods 64 slidably extend through circular openings 68 in the bottom release plate member 40, and have diametrically enlarged retaining members 70 on their lower ends. Members 70 serve to captively retain the release plate member 40 on the rods 64 for sliding vertical movement along their lengths.

To assemble the testing apparatus 10, which holds the plugs 16 for simultaneous insertion in their associated sockets 14, the rear ends 28 of the plugs 16 are placed between adjacent pairs of the front ribs 58 on the retainer bracket member 38 (see FIGS. 2 and 3) so that the electrical cables 34 loop rearwardly around the rear ribs 56 as shown in FIGS. 1 and 2. The top plate member 36 is then placed on the top sides of the ribs 56,58 (see FIG. 2) in a manner causing the retaining pins 46 to downwardly enter the recesses 29 in the top side surfaces of the rear plug end portions 28 (see FIGS. 2 and 3). The top plate member 36 is then secured in place on the retainer bracket member 38 by extending screws 72 (see FIG. 3) downwardly through the holes 48 in the top plate member 36 and threading the screws into the holes 62 in the retainer bracket member 38. Screws 72 have been deleted from FIGS. 1 and 2 for purposes of illustrative clarity.

The securement in this manner of the top plate member 36 to the underlying retainer bracket member 38 releasably locks rear end portions of the modular plugs 16 in place within the testing apparatus 10, with the plug bodies 26 projecting outwardly in a forward direction from the front side edges 42,52 of the top plate member 36 and the retainer bracket member 38 as shown in FIGS. 1 and 2. The retaining pins 46 received in the plug recesses 29 prevent appreciable movement of the plugs 16 in front-to-rear directions relative to the apparatus 10, while the front ribs 58 prevent appreciable side-to-side movement of the plugs 16 (i.e., toward the ends of the top plate member 36) relative to the apparatus 10. The plug latching tabs 30 underlie the tab recesses 60 (see FIG. 2) in a manner permitting the tabs 30 to be resiliently bent up into the recesses 60 to move the tabs 30 to their unlatching positions to permit the plugs 16 to be removed from their associated sockets 14 in a manner later described herein.

With the plugs 16 captively retained in the testing apparatus 10 in this manner, a technician can simply grasp the assembled apparatus 10 and manually move it toward the sockets 14 (as indicated by the dashed arrows 74 in FIGS. 1 and 2) to simultaneously insert all six plugs 16 simultaneously into their associated sockets 14 as indicated in dashed lines in the socket side of FIG. 2. The insertion of the plugs 16 into the sockets 14 causes the plug tabs 30 to releasably latch the plugs 16 within the sockets 14. Next, the circuit board 12 may be electrically tested.

As can be seen in FIG. 2, with the testing apparatus 10 is its upright orientation, the bottom release plate member 40 downwardly rests against the retaining members 70. When the testing of the circuit board 12 is completed, the plugs 16 may be simultaneously unlatched from their sockets 14 simply by manually moving the release plate member 40 upwardly, as indicated by the arrow 76 in FIG. 2, to move the release plate 40 upwardly along the retaining rods 64. Such movement of the plate member 40 causes it to upwardly engage the plug latch tabs 30 and deflect them into the tab recesses 60 in a manner simultaneously unlatching all of the plugs 16 from their sockets 14 and permitting the technician to simultaneously remove all of the plugs 16 from their sockets 14.

As can be seen, using the specially designed testing apparatus 10, the plugs 16 can very easily be inserted into and withdrawn from the sockets 14 without placing any stress on the plug cables 34, and without any particular degree of manual dexterity by the technician. Additionally, this testing method advantageously permits a far greater number of circuit boards to be tested in a given time period by eliminating the necessity of inserting and removing the plugs 16 one by one into and from their associated sockets and enabling the plugs 16 to be simultaneously inserted into and removed from the sockets 14.

While the testing apparatus 10 has been illustrated as being manually operable by moving it toward the stationary sockets 14, it will be readily appreciated by those of skill in this particular art that the apparatus 10 could alternatively be held stationary and the circuit board 12 and its associated sockets 14 be moved toward the plugs 16 to effect the plug/socket testing connection. Additionally, the relative connection and disconnection movement between the plugs and sockets could be mechanically effected if desired. Moreover, it will be readily appreciated that while the apparatus 10 has been representatively illustrated as being used with sockets and modular plugs, it could also be used with other types of plugs and sockets or other types of releasably mateable electrical connectors.

Figure 4:
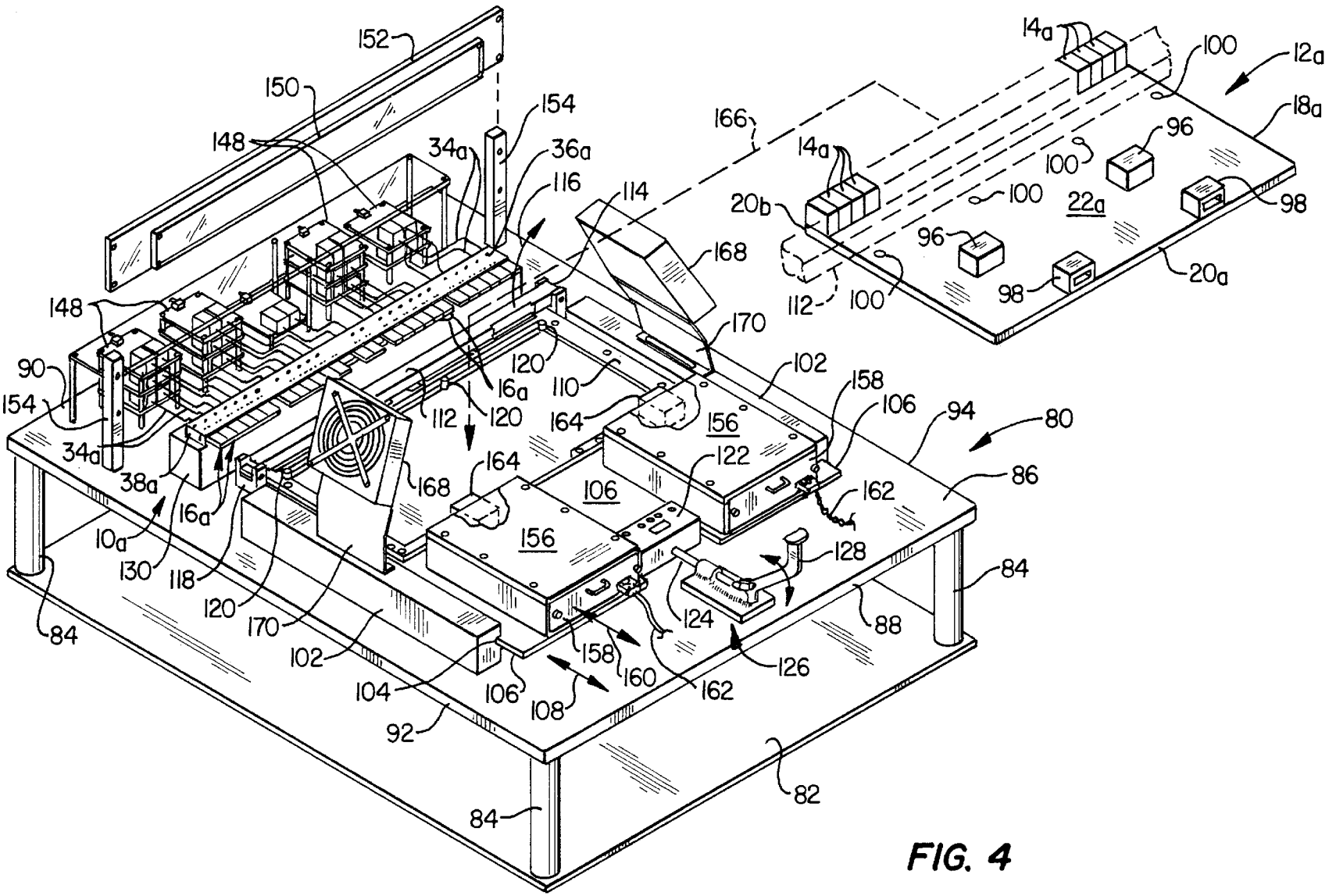
FIG. 4 is a partially exploded perspective view of a specially designed circuit board test stand structure embodying principles of the present invention and incorporating therein an alternate embodiment of the multi-plug support structure.

An alternate embodiment 10*a* of the previously described testing apparatus 10 is illustrated in FIG. 4 and is incorporated in a specially designed circuit board test stand assembly 80 which also embodies principles of the present invention. The test stand assembly 80 is used to electrically test an electronic device, representatively a printed circuit board 12*a* (see FIG. 4), and includes a rectangular base plate 82 having, at its four corner portions, upstanding support posts 84 which hold a rectangular support plate 86 in an elevated, parallel relationship with the base plate 82. Support plate 86 has front and rear side edges 88,90 and left and right side edges 92,94.

The circuit board 12*a*, like the previously described circuit board 12, has a generally planar body 18*a* having a front side edge 20*a*, a rear side edge 20*b*, and a top side 22*a*. Mounted on the top side 22*a* of the circuit board body 18*a* are several heat-generating components 96 (only two of which are shown), a row of electrical connector sockets 14*a* (representatively twenty six in number), and a spaced pair of electrical power supply sockets 98.

The row of sockets 14*a* extends along the rear side edge 20*b* of the circuit board body 18*a*, with the sockets 98 being adjacent the front side edge 20*a* and the components 96 being representatively positioned between the sockets 14*a* and the sockets 98. The sockets 14*a* shown in FIG. 4 are identical to the previously described sockets 14 shown in FIGS. 1–3. For purposes later described, a row of spaced apart circular alignment holes 100 (representatively four in number) is formed in the circuit board body 18 in a forwardly spaced, parallel relationship with the sockets 14*a*.

Still referring to FIG. 4, a spaced pair of parallel elongated slide blocks 102 are mounted on the top side of the support plate 86 and longitudinally extend in front-to-rear directions thereon. Blocks 102 have horizontal channels 104 formed in facing vertical side surfaces thereof, the channels 104 receiving edge portions of a rectangular slide plate structure 106 which is movable forwardly and rearwardly relative to the slide blocks 102 as indicated by the double-ended arrow 108 in FIG. 4.

A rectangular support frame member 110 is secured to a rear portion of the slide plate structure 106 for forward and rearward movement therewith relative to the slide blocks 102. Mounted on a rear top side edge portion of the frame 110 is a reinforcing bar 112 which is pivotally secured at its right end 114 to the frame 110 in a manner permitting the bar 112 to be placed in its indicated horizontal position, or pivoted upwardly away from the frame 110 as indicated by the arrow 116 in FIG. 4. With the bar 112 in its horizontal position its left or free end is received within a generally U-shaped holding bracket 118 secured to the frame 110. A spaced series of four upstanding alignment pins 120 are secured to the rear side of the frame 110 and are receivable in the alignment holes 100 of the body 18 of the circuit board 81 for purposes later described herein.

A connecting block 122 is secured to a central front portion of the slide plate structure and to the output rod portion 124 of a conventional pivotal drive assembly 126 secured to the top side of the support plate 86 and having a pivotally supported control handle 128 operatively linked to the rod 124. By manually rotating the handle 128 toward the slide plate 106 the slide plate 106 is driven rearwardly relative to the blocks 102, and by manually rotating the handle 128 away from the slide plate 106 the slide plate 106 is driven forwardly relative to the blocks 102.

Figure 5:
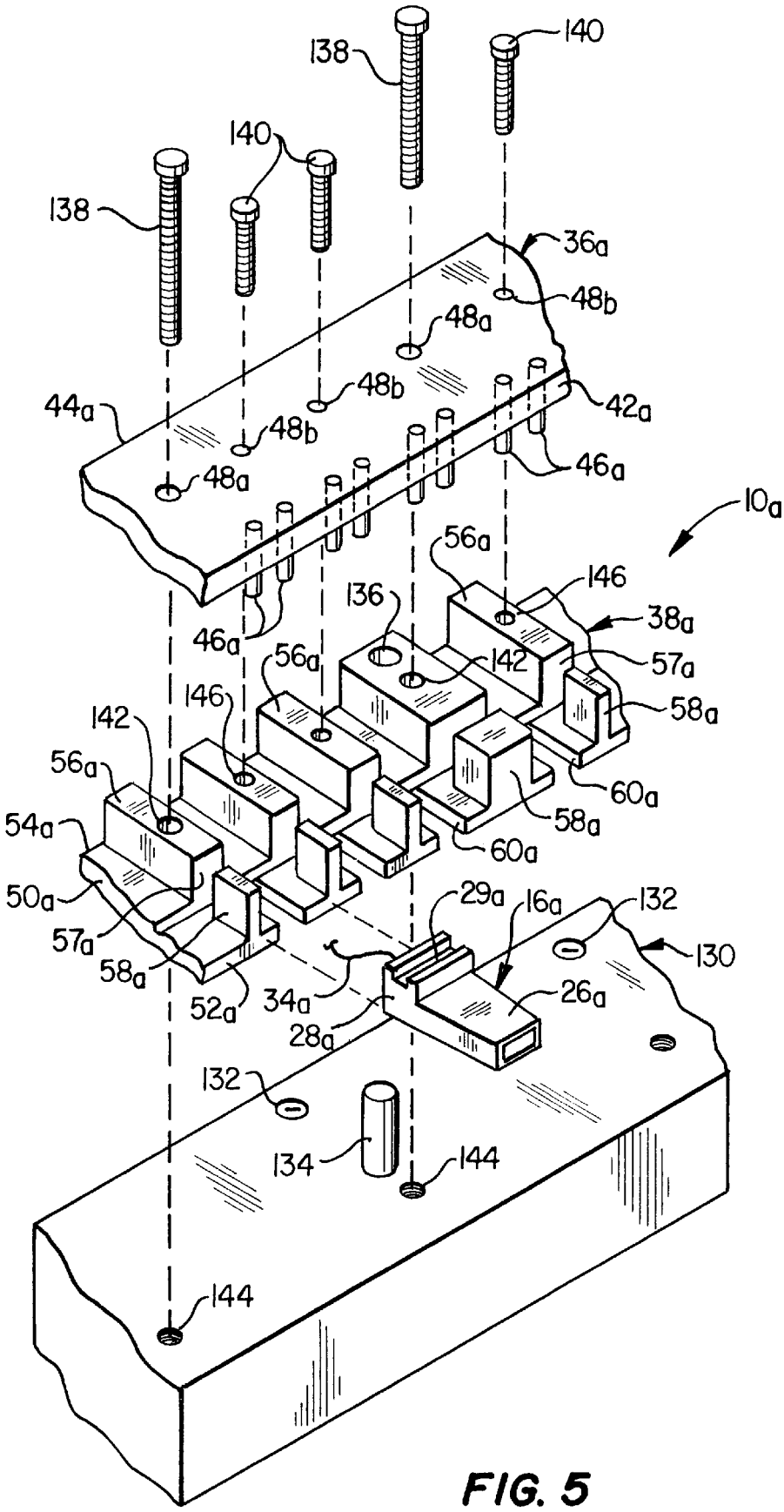
FIG. 5 is an enlarged scale partially exploded perspective view of a portion of the alternate multiplug support structure shown in FIG. 4.

Referring now to FIGS. 4 and 5, the testing apparatus 10*a* is mounted on the top side of the support plate 86, in a rearwardly spaced relationship with the support blocks 102, and is used to operatively support a row of modular test plugs 16*a* (representatively twenty six in number) in a fixed relationship with the support plate 86. The test plugs 16*a* are identical to the plugs 16 previously described in conjunction with FIGS. 1–3 with the exception that their bottom latching tab members (plug elements 30 shown in FIG. 3) have been broken off since, as later described herein, they are not needed in the test procedure utilized in conjunction with the test stand assembly 80.

As best illustrated in FIG. 4, the testing apparatus 10*a* is similar to the previously described testing apparatus 10 and includes an elongated rectangular top plate member 36*a*, an elongated retainer bracket member 38*a*, and an elongated rectangular bottom support block 130. The top plate member 36*a* has front and rear side edges 42*a* and 44*a*, a spaced series of retaining pin members 46*a* depending from the bottom side of the top plate member 36*a* and arranged in a row parallel to and inwardly adjacent its front side edge 42*a*, and a spaced series of circular mounting holes 48*a*,48*b* arranged in a row parallel to its rear side edge 44*a*.

The retainer bracket member 38*a* has an elongated rectangular base plate member 50*a* with front and rear side edges 52*a* and 54*a*. Projecting upwardly from the top side of the base plate member 50*a* are a longitudinally spaced series of rear ribs 56*a* positioned adjacent the rear side edge 54*a* and having front side edges 57*a*, and a longitudinally spaced series of front ribs 58*a* which are positioned adjacent the front side edge 52*a*, aligned with and spaced forwardly apart from the rear ribs 56*a*, and somewhat thinner than the rear ribs 56*a*.

Each adjacent pair of the front ribs 58*a* are spaced apart a distance permitting the upturned rear end portion 28*a* of one of the plugs 16*a* to be complementarily inserted therebetween so that the rear end face of the plug abuts front side edges 57*a* of a corresponding pair of the rear ribs 56*a*. Between each adjacent pair of the front ribs 58*a* a tab recess 60*a* extends rearwardly through the base plate member 50*a* from its front side edge 52*a*.

The support block 130 longitudinally extends in a left-to-right direction as viewed in FIG. 4, is positioned in a rearwardly spaced relationship with the rear side of the support frame 110, and is secured to the top side of the rectangular support plate 86 by screws 132 extending downwardly through corresponding holes in the support block 130 and threaded into the underlying support plate 86.

To assemble the testing apparatus 10*a*, which holds the plugs 16*a* for simultaneous insertion in the associated circuit board sockets 14*a*, the retainer bracket member 38*a* is placed atop the support block member 130 in a parallel relationship therewith. Proper registry between the retainer bracket member 38a and the underlying support block member 130 is achieved by a plurality of upstanding retainer pins 134 (only one of which is shown in FIG. 5) secured to the support block member 130 and extending upwardly through overlying circular holes 136 vertically extending through corresponding ones of the rear retainer bracket member ribs 56*a*.

The plugs 16*a* are then operatively placed in the retainer bracket member 38*a*, between its front ribs 58*a*, with the plug cables 34*a* extending rearwardly through the pairs of rear ribs 56*a*. The top plate member 36*a* is then placed atop the retainer bracket member 38*a* in a manner such that the retaining pins 46*a* enter the top side recesses 29*a* in the upturned rear plug ends 28*a*. Finally, the top plate member 36*a* is removably secured to the retainer bracket member 38*a* and the underlying support block 130 using screws 138 and 140. Screws 138 are extended downwardly through the holes 48*a* in the top plate member 36*a*, passed through vertical holes 142 in underlying rear ribs 56*a*, and threaded into circular holes 144 in the support block 130. Screws 140 are extended downwardly through the top plate member holes 48*b* and threaded into underlying holes in rear ribs 56*a*.

In the assembled test apparatus 10*a*, the bodies 26*a* of the captively retained plugs 16*a* project forwardly beyond the test apparatus 10*a* and are arranged in a row with a relative plug spacing identical to the spacing of the corresponding sockets 14*a* on the circuit board 12*a* to be tested. The rearwardly extending plug cables 34*a* are operatively connected to a conventional array of test boards 148 used during the testing of the circuit board 12*a* to controllably switch selected ones of the plugs 16*a* on and off. A conventional test display board 150 is horizontally supported in an elevated position behind the plug-supporting test apparatus 10*a* on a horizontally elongated rectangular support panel 152 secured to the upper ends of a pair of post members 154 fastened at their lower ends to the support plate 86.

For purposes later described herein, a pair of specially designed support housings 156 embodying further principles of the present invention are secured to the top side of the slide plate 106 on opposite sides of the connecting block 122. Each housing 156 has a rectangular cross-section and open front and rear ends, and receives a rectangularly cross-sectioned electrical power supply box 158 which is slidable in forward and rearward directions, as indicated by the double-ended arrow 160 in FIG. 4, relative to its associated support housing 156. An electrical power supply cable 162 is plugged into the front end of each power supply box 158, and an electrical power supply plug 164 projects outwardly from the rear end of each of the power supply boxes 158. The plugs 164 are mateable with the circuit board electrical supply sockets 98 and are spaced horizontally apart from one another, in a left-to-right direction, a distance equal to the corresponding spacing between the electrical supply sockets 98.

To electrically test the circuit board 12*a* the control handle 128 is pivoted forwardly to its FIG. 4 position, the reinforcing bar 112 at the front end of the support frame 110 is raised, and the power supply boxes 158 are slid forwardly within their open-ended support housings 156. As indicated by the dashed arrow 166 in FIG. 4, the circuit board 12*a* is then placed atop the support frame 110 in a manner causing its alignment pins 120 to upwardly enter the corresponding alignment holes 100 in the circuit board body 18*a* to thereby prevent the circuit board body 18*a* from shifting horizontally relative to the underlying support frame 110.

The support bar 112 is then lowered, as indicated in phantom in the circuit board portion of FIG. 4, so that it is positioned against the front sides of the plug sockets 14*a*. With the circuit board 12*a* secured to the support frame 110 as described above, the control handle 128 is pivoted rearwardly to correspondingly force the slide plate rearwardly in a manner simultaneously forcing each of the sockets 14*a* onto an associated one of the stationary modular plugs 16*a*. During entry of the plugs 16*a* into the sockets 14*a*, the lowered reinforcing bar 112 serves to brace the sockets 14*a* to prevent the plug insertion forces from loosening their connections to the circuit board body 18 or otherwise damaging the circuit board. Additionally, the anchoring of the plugs 116*a* relative to the test apparatus 10*a* prevents any appreciable forces from being exerted on the plug cables 34*a*.

The power supply boxes 158 are then slid rearwardly through their support housings 156 to mate the power supply plugs 164 with the facing power supply sockets 98 on the circuit board 12*a* to supply electrical power to the circuit board 12*a* which is then tested in an appropriate manner. Heat generated by the circuit board components 96 during testing is dissipated by a pair of conventional cooling fans 168 supported above opposite ends of the circuit board 12*a* on support members 170 secured to the slide blocks 102.

After the circuit board 12*a* has been tested, the power supply boxes 158 are slid forwardly in their support housings 156 to remove the power supply plugs 164 from the circuit board power sockets 98, and the control handle 128 is pivoted forwardly to forwardly move the slide plate structure 106 and simultaneously pull the circuit board sockets 14*a* off the stationarily supported modular test plugs 16*a*. The reinforcing bar 112 is then pivoted upwardly and the tested circuit board 12*a* is removed from the test stand assembly 80 and replaced with another circuit board to be tested.

In the test apparatus embodiment shown in FIGS. 4 and 5, the plugs 16*a* are held stationary and the sockets 14*a* are moved toward the plugs. However, as will be readily appreciated by those of skill in this particular art, the sockets 14*a* could alternatively be held stationary and the plugs moved toward the stationary sockets. Additionally, while the test apparatus 10*a*,80 has been illustrated as being used to test a printed circuit board having plug-receiving sockets thereon, it will be readily appreciated that such apparatus could alternatively be used with other types of electronic apparatus to be tested and with other types of electrical connectors thereon which must be removably mated with corresponding test connectors.

The foregoing detailed description is to be clearly understood as being given by way of illustration and example only, the spirit and scope of the present invention being limited solely by the appended claims.

What is claimed is:

1. An apparatus for testing an electronic device having a series of first electrical connectors thereon, said apparatus comprising:

a series of second electrical connectors releasably mateable with said series of first electrical connectors; and a support structure operable to support said series of second electrical connectors in an arrangement permitting them to be simultaneously mated with said first electrical connectors in response to a predetermined relative movement between the electronic device and said support structure, one of said series of first electrical connectors and said series of second electrical connectors being sockets, and the other of said series of first electrical connectors and said series of second electrical connectors being plugs receivable in said sockets and having latch portions operative to removably retain said plugs within said sockets, said latch members being deflectable to permit withdrawal of the received plugs from their associated sockets; and a release structure carried by said support structure and being operative to simultaneously deflect the latch members of the received plugs to permit the simultaneous withdrawal thereof from their associated sockets.

2. The apparatus of claim 1 wherein:

said first electrical connectors are sockets, and said second electrical connectors are plugs.

3. The apparatus of claim 2 wherein:

the electronic device is a circuit board, and said plugs are modular plugs.

4. The apparatus of claim 3 wherein said modular plugs are RJ45 plugs.

5. The apparatus of claim 1 wherein said support structure includes:

wall members defining a row of cavities adapted to receive portions of said second electrical connectors, and means for precluding appreciable movement of said second electrical connectors relative to said support structure.

6. The apparatus of claim 5 wherein said cavities are configured to complementarily receive first portions of said second electrical connectors, with second portions of said second electrical connectors projecting outwardly from said support structure.

7. The apparatus of claim 5 wherein:

said portions of said second electrical connectors have exterior surface depressions therein, and said means for precluding appreciable movement include projections disposed on said support structure and receivable in said exterior surface depressions.

8. The apparatus of claim 5 wherein said support structure includes:

a first plate member having said wall members projecting transversely outwardly from a side surface thereof, a second plate member, and means for removably interconnecting said first and second plate members in a parallel relationship with said wall members extending transversely between said first and second plate members.

9. The apparatus of claim 1 wherein said release structure includes a release member carried by said structure for movement relative thereto selectively into and out of deflecting engagement with the latch members of the received plugs.

10. An apparatus for testing an electronic device having a series of first electrical connectors thereon, said apparatus comprising:

a series of second electrical connectors releasably mateable with said series of first electrical connectors;

a support structure operable to support said series of second electrical connectors in an arrangement permitting them to be simultaneously mated with said first electrical connectors in response to a predetermined relative movement between the electronic device and said support structure; and a test stand assembly including:

a base portion, first means for securing said support structure on said base portion in a fixed relationship therewith, and second means for supporting the electronic device on said base portion for selective movement relative thereto toward and away from said base portion.

11. The apparatus of claim 10 wherein:

the electronic device has a power receiving connector thereon for receiving electrical power from a source thereof, and said test stand assembly further includes an electrical power supply structure having a power supply connector disposed thereon and releasably mateable with said power receiving connector, and holding apparatus for supporting said electrical power supply structure for movement toward and away from said second means to permit said power supply connector to be selectively mated with and uncoupled from said power receiving connector when the electronic device is supported by said second means.

12. The apparatus of claim 11 wherein:

said holding apparatus is carried on said second means for movement therewith relative to said base portion.

13. The apparatus of claim 12 wherein:

said electrical power supply structure is an electrical power supply box, and said holding apparatus is a housing slidably receiving said electrical power supply box.

14. The apparatus of claim 10 wherein said test stand assembly further includes a bracing structure operative to brace the series of first electrical connectors against connection forces imposed thereon by said second electrical connectors.

15. The apparatus of claim 14 wherein said bracing structure includes a bracing member carried by said second means and movable relative thereto into and out of a bracing position relative to the first electrical connectors on the electronic device when it is supported on said second means.

16. An apparatus for supporting a series of modular electric plugs for use in testing an electronic device having a series of electrical sockets thereon with which the electrical plugs are releasably mateable, the electric plugs having end portions with exterior surface depressions therein, said apparatus comprising:

a first plate member having a side from which a spaced series of retaining portions transversely project;

a retainer member having a base defined by a second plate member having a series of transverse rib structures projecting from a first side thereof and having first lateral portions spaced to complementarily receive between adjacent pairs thereof said end portions of the plugs; and means for removably securing said first plate member to said retainer member in a manner such that said rib structures extend between said first plate member and said second plate member, and said retaining portions extend into the spaces between said first lateral rib portions for receipt in said exterior surface depressions of said end portions of the plugs.

17. The apparatus of claim 16 wherein:

the modular electric plugs have deflectable latch portions, and said apparatus further comprises a release structure operable to simultaneously deflect said latch portions.

18. The apparatus of claim 17 wherein said release structure includes:

a release member carried by said second plate member for movement toward and away from the second side thereof into and out of deflecting engagement with said latch portions of the modular plugs carried by said apparatus.

19. The apparatus of claim 18 wherein said second plate member has cutout areas disposed therein and positioned and configured to receive parts of the deflected latch portions.

20. The apparatus of claim 16 wherein:

said rib structures have second lateral portions having side edge portions positioned and configured to limit the insertion depth of said end portions of the modular plugs received between adjacent pairs of said first lateral portions of said rib structures.

* * * * *